US006011206A

United States Patent [19]

Straley

[11] Patent Number: 6,011,206

[45] Date of Patent: Jan. 4, 2000

[54] MUSICAL INSTRUMENT—THE RIBBON HARP

[76] Inventor: Joseph Paige Straley, 642 Mayview Dr., Charlotte, N.C. 28205

[21] Appl. No.: 09/019,028

[22] Filed: Feb. 5, 1998

[51] Int. Cl.[7] ..... G10D 13/08

[52] U.S. Cl. ..... 84/402; 84/350; 84/351; 84/378; 84/329; 84/402; 84/322; 84/297 S; 84/404; 84/330

[58] Field of Search ..... 84/350, 351, 378, 84/329, 322, 402, 297 S, 408, 330

[56] References Cited

U.S. PATENT DOCUMENTS

| | | | |
|---|---|---|---|
| 1,542,147 | 6/1925 | Kragiel . | |
| 1,766,095 | 6/1930 | Beall . | |
| 2,508,831 | 5/1950 | Lippman . | |
| 2,570,816 | 10/1951 | Kimple . | |
| 4,102,234 | 7/1978 | Brundage | 84/322 |
| 4,982,641 | 1/1991 | Duhart | 84/329 |
| 5,542,331 | 8/1996 | Hatmann et al. | 84/383 A |
| 5,801,319 | 9/1998 | Hebestreit et al. | 84/297 S |

*Primary Examiner*—Karen Masih
*Assistant Examiner*—Kim Lockett

[57] ABSTRACT

The ribbon harp is a mouth-blown musical instrument consisting of a thin ribbon-like textile or polymeric object. When held between the thumbs and blown on by mouth, the ribbon harp vibrates in the audible frequency range and produces a musical note. The player may vary the tension in the ribbon in order to vary the fundamental frequency with which the ribbon harp vibrates, thus producing higher or lower pitches. Various methods may be used to provide lengthwise strength. Dampening properties can be tuned by varying properties in the crosswise direction. Aerodynamic surface treatments are provided so that the ribbon harp commences to vibrate immediately on being blown across. A wrist harness or gauntlet and a thumb cot are described as aids to the player.

18 Claims, 6 Drawing Sheets

MUSICAL INSTRUMENT— THE RIBBON HARP

BACKGROUND OF THE INVENTION

This invention relates to the field of mouth-blown wind instruments for the performance of music.

In the family of instruments nearest to the present invention, exhaled breath is directed across a reed or a vibrating membranous element. An example of a related mouth-blown wind instrument is the harmonica.

In such a wind instrument aerodynamic forces on either side of a planar element are unbalanced causing the planar element to deflect. A rapid series of back and forth deflections may be initiated in this manner, and if their fundamental frequency is in the range approximately 20–25000 hertz, then the vibration can be detected by the human ear as sound.

PRIOR ART

The ribbon-harp is suggested by the common trick of picking a blade of grass, placing it between the thumbs, and blowing past it to produce a squawking noise. Several deficiencies exist in naturally-occurring blades of grass which prevent them as being considered even as crude musical instruments.

1. The weak structure of grass often causes the blade to break due to the forces of the vibrations.

2. The weak structure of grass allows the blade to fail if the player attempts to put more tension on the blade in order to alter the fundamental tone.

3. Though some control of the fundamental tone is possible by putting tension on the blade of grass, no control of overtones is possible. A cacophonous squawk is the result, and the tone is usually adjudged as unmusical.

4. Grass blades are slippery, and it is difficult to hold the blade and change the tension.

5. Grass blades are highly variable, and the tones and response to playing style is unpredictable.

A review of the PTO file reveals no existing or expired patents which claim the features of the ribbon harp. Four patents have some similarities, but are not sufficiently close to the present invention to interfere with its patentability. An Information Disclosure Statement, complete with copies of the cited patents, is included with this patent application .

U.S. Pat. No. 3,744,365 shows a device to be held in the mouth with a membranous vibrating element which is excited by exhaled breath. The frame of the device is held by the lips, and by biting down the pressure of the lips is transferred to the membranous element. The greater the tension in the vibrating member the higher the fundamental frequency at which it will vibrate.

U.S. Pat. No. 3,744,365 holds the vibrating element in a manufactured framework. By comparison, the ribbon harp is held directly in the hand. Further, jaw pressure or lip pressure provides the exertion necessary to put tension in the vibrating member. The ribbon-harp uses the hand and wrist of the player to put tension in the vibrating member.

U.S. Pat. No. 3,744,365, in contrast to the present invention, provides no teaching on controlling overtone frequencies apart from the fundamental. Likewise, it provides no teaching on texturizing the surface of the vibrating element to provide immediate response to a n input of breath, that is, immediate attack on a note.

Thus U.S. Pat. No. 3,744,365 does not provide prior art on which the present invention infringes.

U.S. Pat. No. 2,570,816 provides a vibrating membranous element held between two bowed elastic elements. The device is held to the lips and exhaled breath directed across the vibrating membranous element. The players fingers hold the bowed elements, and by pressing inward the outer ends, to which the membranous vibrating element is attached, are forced apart. This increases the tension in the vibrating membranous element which in turn causes a high frequency fundamental tone to be produced when the vibrating membranous element is excited by exhaled breath.

U.S. Pat. No. 2,570,816 provides a mechanical framework to hold the vibrating membranous element. By contrast, a player using the present invention holds the vibrating element directly in the hand. The mechanical forces to increase the tension in the vibrating element stem from cocking the wrist in the present invention, whereas the mechanical forces to increase the tension in the vibrating element of U.S. Pat. No. 2,570,816 come from direct finger pressure on the bowed elements.

U.S. Pat. No. 2,570,816 in contrast to the present invention, provides no teaching on controlling overtone frequencies apart from the fundamental. Likewise, it provides no teaching on texturing the surface of the vibrating element to provide immediate response to a n input of breath, that is, immediate attack on a note.

U.S. Pat. No. 1,766,095 describes a hand-held, mouth-blown musical instrument. However, the source for the fundamental tone is a vibrating column of air, that is, a whistle. This is a substantially different way of producing the fundamental tone as compared to the present invention. U.S. Pat. No. 1,766,095 provides no method for engineering the item to control musical overtones and thus the timbre of the produced sound. This likewise is in contrast to the teaching for the present invention.

U.S. Pat. No. 1,542,147 describes a musical toy which incorporates an elastic member whose vibration is excited by exhaled breathe. The fundamental tone is controlled by tension in the elastic member. However, U.S. Pat. No. 1,542,147 incorporates a metal framework to hold the vibrating elastic element. The present invention is held in the hands, and there is no framework. The vibrating element in U.S. Pat. No. 1,542,147 is elastic. The present invention insists on the vibrating element as having great strength in the longitudinal direction so as to resist elastic deformation. U.S. Pat. No. 1,542,147 provides no teaching on controlling the voice, overtones, and timbre of the produced sound. This likewise is in contrast to the teaching for the present invention.

It will also be obvious to the reader than the inventions cited above do not incorporate features such as the wrist gauntlet and the thumb cot. These features, designed to provide comfort and facility to the player, are simply not called for by the design of the cited patents.

OBJECTS AND ADVANTAGES

Accordingly, several objects and advantages of the present invention are listed following:

In general, the ribbon harp solves the problem of providing a mouth blown musical instrument which:

a. requires no additional mechanical parts except the vibrating element; and b. possesses engineering features allowing it to produce a fundamental tone and overtones giving a distinct musical character to its sound; and c. is simple to manufacture so as to be predictable in its performance.

Other objects and advantages of the ribbon harp are:

a. The present invention has the benefit of great simplicity. It is simple to manufacture and should be inexpensive to purchase, thus making it available to people of all economic stations. Because of its simplicity and the intuitive nature of its operation, a ribbon harp can be played with great facility by accomplished players yet a beginner can play simple melodies very easily.

b. Because the hands are cupped, and the shape and volume of the cupped space can be changed, the resonating cavity formed by the cupped hands can easily be changed by the player to suit the music being played. The technique of cupping the hands and changing the character of the resonating chamber thereby formed is well known to harmonica players specializing the blues music form. A ribbon harp likewise especially lends itself to playing blues music.

c. The ribbon-harp is very lightweight and portable. Therefore, it will be a desirable item among backpackers, campers, and others to whom light weight and portability is extremely important.

d. A ribbon harp can be used as a toy, but since it also allows serious musical performance it offers the possibility of bridging a young player from mere play to actual performance of simple melody, and potentially to sophisticated performance on the same instrument.

e. Many objects and advantages of the ribbon harp relate to the structure and composition of the ribbon, as well as elements of the process involved in its manufacture. While a ribbon harp may appear as a simple strip of material, the engineering and design are complex. The following objects and advantages, f through m, demonstrate this assertion.

f. The ribbon harp is made tough in order to withstand high-frequency flexure under strong tension without breaking.

g. The selvedge edge of a woven ribbon harp helps prevent unraveling.

h. Because the ribbon has stable lengthwise stress-strain relationships, the same tension will produce the same fundamental frequency and the player can hit notes accurately throughout a performance.

i. The ability to specify the width of the ribbon, the unit mass per length, and the damping properties of materials allows both control of the voice of the instrument, e.g., bass, tenor, mezzo, and the timbre of the voice. Timbre control is obtained through suppression of unwanted cacophonous overtones.

j. Surface treatment, whether by texturizing or by formation of aerodynamic surfaces, promotes immediate initiation of vibrations when the ribbon-like member is excited by energy from mouth-blown wind. This facilitates both the attack on notes and the ability of the instrument to play soft passages.

k. The loop in one end allows easy formation of a loop through which the player's wrist is thrust. The wrist loop allows the strong muscles of the forearm or the opposing hand to be used to impart tension to the ribbon. Thus relatively large tensions may be imparted to the ribbon, providing a means whereby the frequency range (tonal range) may be extended to one or more octaves of standard musical note frequencies.

l. A sticky thumb cot provides strong friction against the ribbon when the ribbon is pressed against it by a free finger. This securely anchors the upper end of the ribbon and allows strong tensions to be produced in the ribbon without undue exertion of the free finger.

m. The wrist gauntlet distributes the tension forces in the ribbon forces over a large area of the wrist, allowing strong forces to be produced in the ribbon without pain or discomfort in the area where the ribbon harp loop passes around the wrist of the player.

The above is a recitation of the main objects and advantages of the present invention, but it is not an exhaustive list. Still other objects and advantages of the ribbon harp will become obvious from consideration of the remaining description of this invention.

DESCRIPTION OF DRAWINGS

FIG. 14 is nominated as the OFFICIAL GAZETTE illustration.

LIST OF REFERENCE NUMERALS

Figure 1:
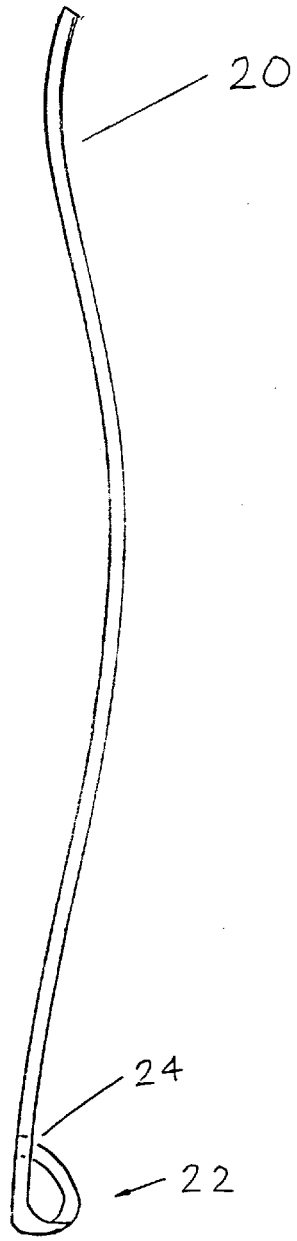
FIG. 1 shows the general form of a ribbon harp.

20. Body of the ribbon harp
22 Loop
24 Sewn, glued, or bonded attachment
26 Longitudinal (long-axis, lengthwise) fibers.
28 Latitudinal (short axis, crosswise) fibers.
30 Selvedge.
32. Longitudinal fiber of differing strength or thickness
34 Cast or extruded polymeric ribbon harp.
38 Cast or extruded polymeric ribbon harp having differing aerodynamic profile on either side.
40. Ribbon harp of cast or extruded polymeric material having few longitudinal fibers.
42. Longitudinal strengthening fibers.
44. Ribbon harp of cast or extruded polymeric construction with texturized planar surfaces
46. Surface texture feature in the form of a pit.
48. Surface texture feature in the form of a bump.
50. Ribbon harp of extruded polymeric material with surface texture in the form of longitudinal ridges.

52. Longitudinal ridge.
54. Cross section of ribbon harp of polymeric material showing longitudinal ridges formed during the casting or extruding process.
56. Ribbon harp in position on the right wrist of a player.
60. Position of small loop 22 in the playing position.
62. Ribbon harp held in hands in the playing position.
64. Wrist gauntlet.
66. Attachment stud.
68. Thumb cot.

SUMMARY

The ribbon harp is a ribbon of woven fabric or polymeric composition which can be held between the thumbs, and will vibrate when a breath of air is blown over it. Increasing the tension within the ribbon will change the fundamental vibration frequency so that a player can control the note being played. Engineering features of the ribbon allow the voice and timbre to be tuned so that a dominant fundamental tone is produced under playing conditions. Discordant or dissonant overtones can be damped or eliminated by selecting the properties of the ribbon. A thumb cot and a wrist harness may optionally be used to prevent discomfort when playing a ribbon harp.

DESCRIPTION OF THE INVENTION. FIGS. 1 to 15B

Figure 2:
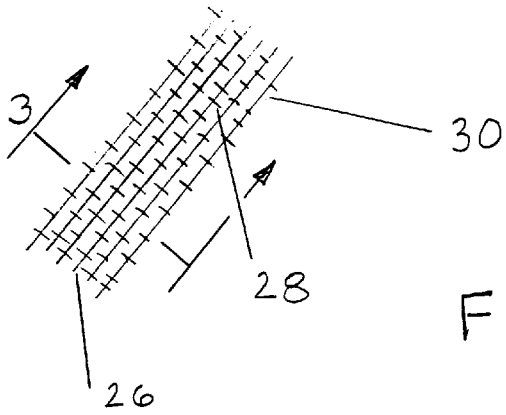
FIG. 2 shows a ribbon harp of woven construction and the provision of selvedge.
Figure 3A:
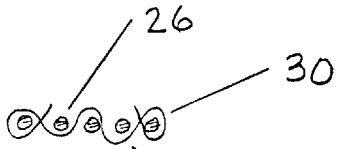
FIG. 3A shows a section view of the woven ribbon harp of FIG. 2 having uniform longitudinal fibers.
Figure 3B:
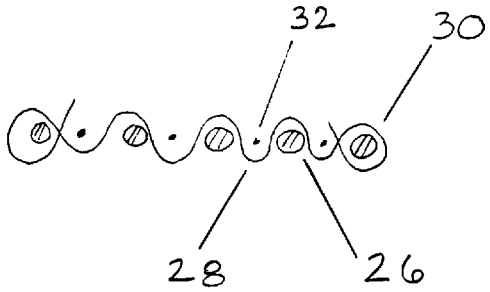
FIG. 3B shows a section view of the woven ribbon harp of FIG. 2 having non-uniform longitudinal fibers.
Figure 4:
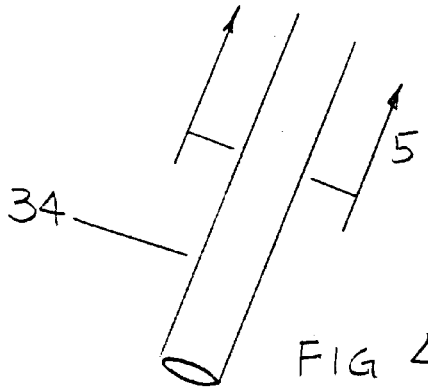
FIG. 4 shows a ribbon harp of cast or extruded polymeric construction with plain surfaces.
Figure 5:
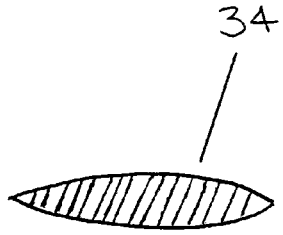
FIG. 5 shows a section view of FIG. 4
Figure 6:
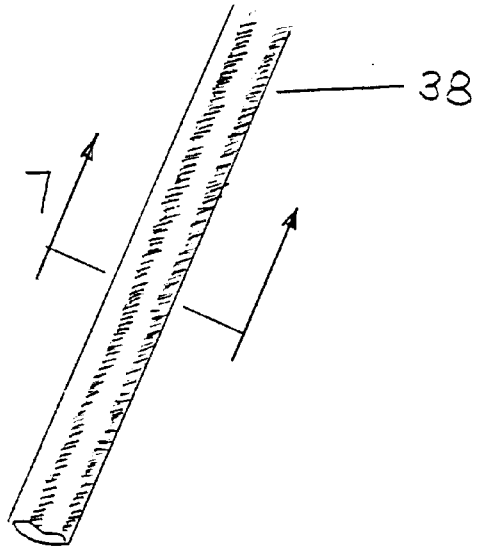
FIG. 6 shows a ribbon harp with planar surfaces whose aerodynamic profile differs on either side.
Figure 7:
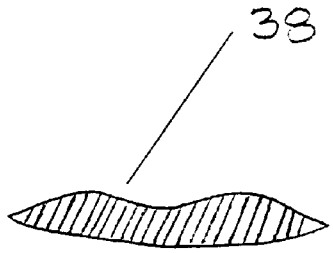
FIG. 7 shows a section view of FIG. 6.
Figure 8:
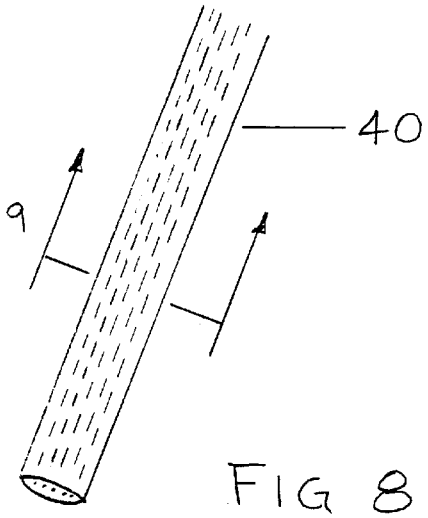
FIG. 8 shows a ribbon harp with few longitudinal fibers and having cast or extruded polymeric construction.
Figure 9:
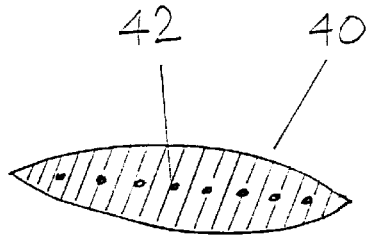
FIG. 9 shows a section view of FIG. 8.

The invention is a vibrating ribbon which may be used as a musical instrument. It may be made of primarily a single polymeric material as shown in FIGS. 4 and 5. An alternative embodiment is a woven fabric as shown in FIG. 2.

The length of the ribbon harp is typically 35 cm. Players may trim the ribbon to length for convenience. The width of the ribbon varies from 1 to 10 mm; typically 2.5 to 7 mm.

The ribbon has varied weight per length. In woven ribbon harps this is controlled by several factors such as width, density of weave, thread characteristics, and resin characteristics. In ribbon harps of primarily single polymeric materials weight per length is controlled by volume per length and polymer density. Weight per length is a critical factor for control of the fundamental frequency. Weight per length varies from 0.01 grams/cm to 2 grams/cm, with varied weight classes selected for the desired voice.

Ribbon harps made primarily of a single polymeric material may be made with no aerodynamic asymmetry or surface treatment, and also with no longitudinal reinforcement. Such ribbon harp is shown in FIGS. 4 and 5. This is the simplest form of the ribbon harp.

A ribbon harp made primarily of a polymeric material may have longitudinal reinforcement. In this case, illustrated in FIGS. 8 and 9, a few strong fibers 42 may be imbedded in the polymeric material. These fibers provide added strength in the longitudinal, or lengthwise, direction.

Ribbon harps made primarily of a single polymeric material may have asymmetric planar surfaces 38. They may also have calendared or roll-embossed surface treatments. These design features, shown in FIGS. 3B, 6, 7, 10, 11A, and 11B, produce unbalanced forces on either side of the ribbon harp when air is blown across its surface. These features promote the immediate initiation of vibrations in the ribbon, known musically as an immediate attack upon the note. These features also allow the initiation of vibrations when a small flux (mass per time) of air being blown across the ribbon harp. This facilitates the playing of soft or low volume musical phrases.

Figure 10:
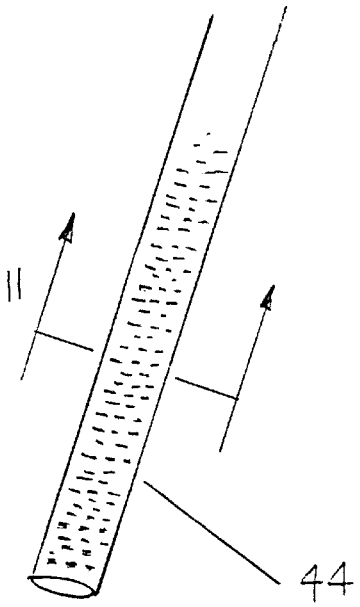
FIG. 10 shows a ribbon harp with a textured planar surface, either pits or bumps.
Figure 11A:
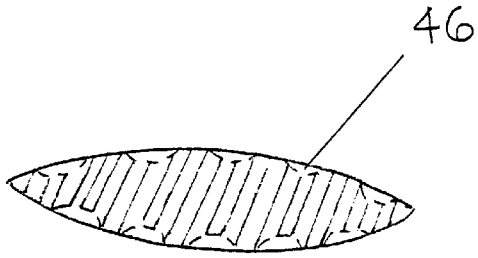
FIG. 11A shows a section view of ribbon harp of FIG. 10 with the texture produced at a series of pits.
Figure 11B:
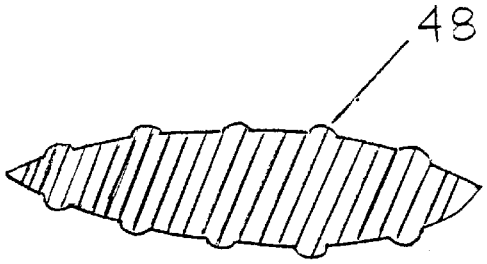
FIG. 11B shows a section view of the ribbon harp of FIG. 10 with the surface texture produced as a series of bumps.
Figure 12:
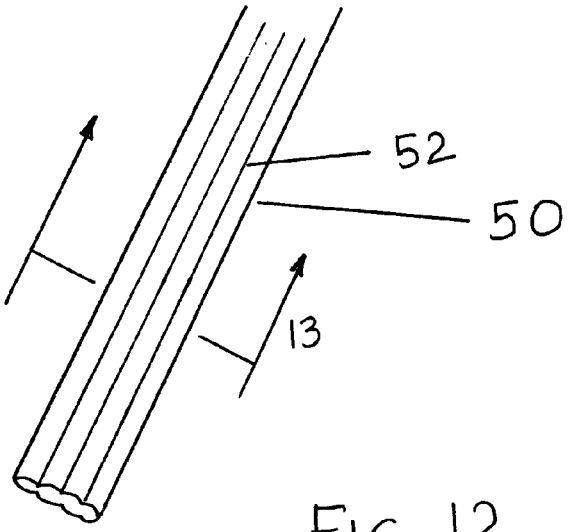
FIG. 12 shows a ribbon harp of cast or extruded construction with the surface texture produced as striations.
Figure 13:
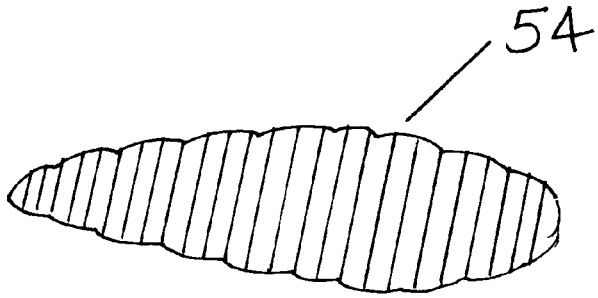
FIG. 13 is a section view of FIG. 12 showing the surface character of the striations.

Ribbon harps made primarily of a single polymeric material may have surface textures or treatments of various forms. Pits 46 of varying depths, diameters, and spacing may be pressed or cast into the ribbon harp, as shown in FIGS. 10 and 11A. Small bumps 48 may likewise be introduced onto the surface, as shown in FIGS. 10 and 11B. A ribbon harp made primarily of a polymeric material may also be manufactured by extrusion, and in this case surface texture may be provided by providing a ribbed or striated surface 54 which is created by the extrusion die, illustrated in FIGS. 12 and 13. Ribbon harps made by injection molding may have surface texture in the form of ribs, pits or small knobs, which texture is a designed and included in the molding die.

The fibers in a woven ribbon harp may be of various materials, but in a preferred embodiment the length wise fibers are kevlar or nylon. These strong materials stretch very little under the tension of playing. The crosswise fibers 28 are also of various materials such as cotton, polyester, rayon, nylon, polyethyleneterephthalate. or other common textile fibers. In a preferred embodiment polyester may be used in as the crosswise thread in a woven ribbon harp.

Woven ribbon harps are either impregnated with polymeric materials after weaving or the resin is introduced to the fiber previous to weaving. Various types of resin are used, among which are polyethylene, polypropylene, polystrene, etc. In a preferred embodiment polyethylene is calendered onto the surface of the ribbon and a surface texture is embossed thereon by a mechanical roll.

The loop 22 at one end of the ribbon is simply formed and sewed back onto itself as illustrated in FIG. 1. Sewing is the preferred means of attachment for woven ribbon harps, but gluing or heat fusing can be used for ribbon harps made primarily of a single polymeric material. The loop 22 can be used either to form a larger loop from the free end of the ribbon , said large loop to be passed around the wrist; illustrated in FIG. 14, or used as an attachment to the knobbed 66 wrist gauntlet as shown in FIGS. 15A and 15B.

Figure 15A:
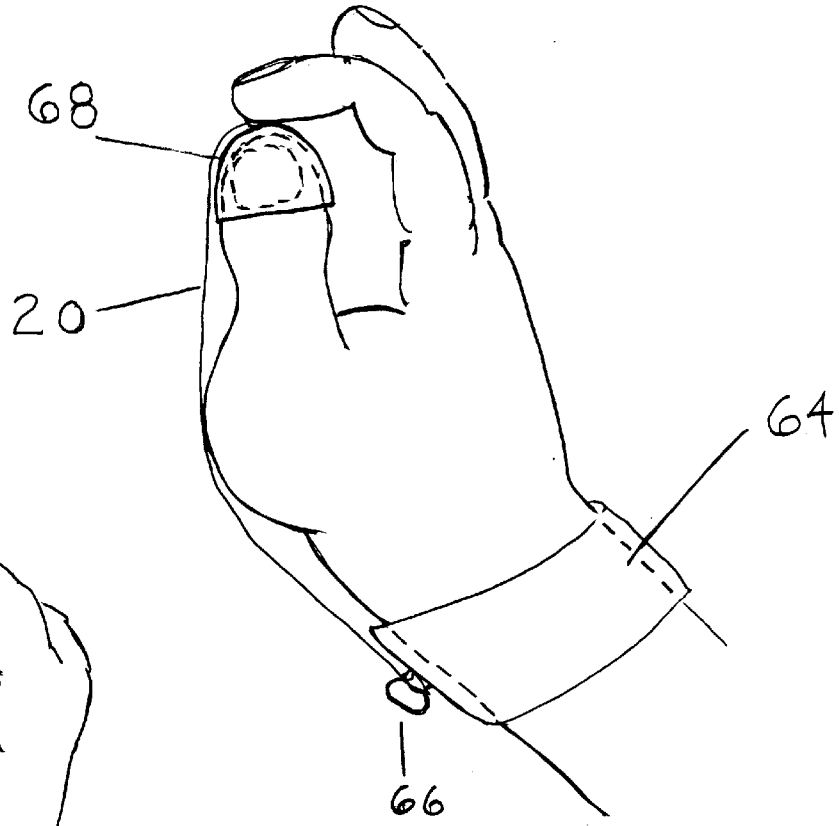
FIG. 15A shows a ribbon harp in playing position with a wrist gauntlet and a thumb cot.
Figure 15B:
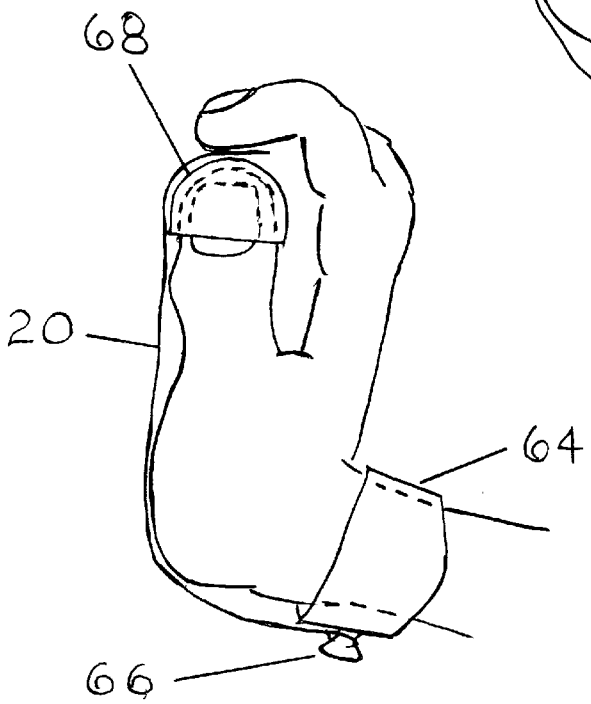
FIG. 15B shows an alternative wrist position for the ribbon harp of FIG. 15A

A wrist gauntlet 64, shown in FIGS. 15A and 15B, provides a large surface area over which the forces induced by the tension in the ribbon are resolved into the forearm. This eliminates pinching or discomfort while playing the ribbon harp. A wrist gauntlet also provides a secure attachment 66 for the loop one end of the ribbon harp.

A thumb cot, FIGS. 15A and 15B, is used to provide a more secure anchor for holding the top of the ribbon harp fast against the top of the thumb. A secure anchor point aids in accurate performance. A thumb cot also reduces the muscular effort necessary to hold the end of the ribbon harp firmly and without slippage, and thus reduces fatigue during long playing sessions.

When a ribbon harp is played, the tone can be captured on a recording. The fundamental and associated overtones can then be analyzed using the mathematical tool of the Fourier transform. Fourier analysis of tones is an established technique, and is in fact used in order to allow computer driven instruments such as synthesizers to produce tones which can be identified as specific instruments, say, a trumpet. A synthesizer trumpet sound is nothing more than a mathematical computer algorithm which passes a signal to an amplifier and thence to the speaker, which algorithm is derived from Fourier transform analysis of actual trumpet tones.

Therefore, an engineer skilled in the art of tone analysis can easily specify factors such as lengthwise threads, crosswise threads, resin materials, ribbon unit weights, and ribbon widths which affect the musical tone of the ribbon harp.

In this way the harp is tuned to establish its voice and timbre. Discordant or dissonant overtones can be dampened or eliminated.

Although the description above contains specific examples of ribbon harp design, these do not limit the entire scope of the design but merely serve as examples of some presently preferred embodiments. For example, the full scope of available materials for making threads could conceivably be used as either lengthwise or crosswise threads in the woven ribbon harp. Another example is the combination of design principles, such as when a few long strengthening fibers 42 are used in an extruded ribbon harp having striations 54, that is, the combination of features seen in FIGS. 8, 9, 12, and 13.

Thus the scope of the present invention should be limited by the claims following and their legal equivalents rather than by the examples given.

Figure 14:
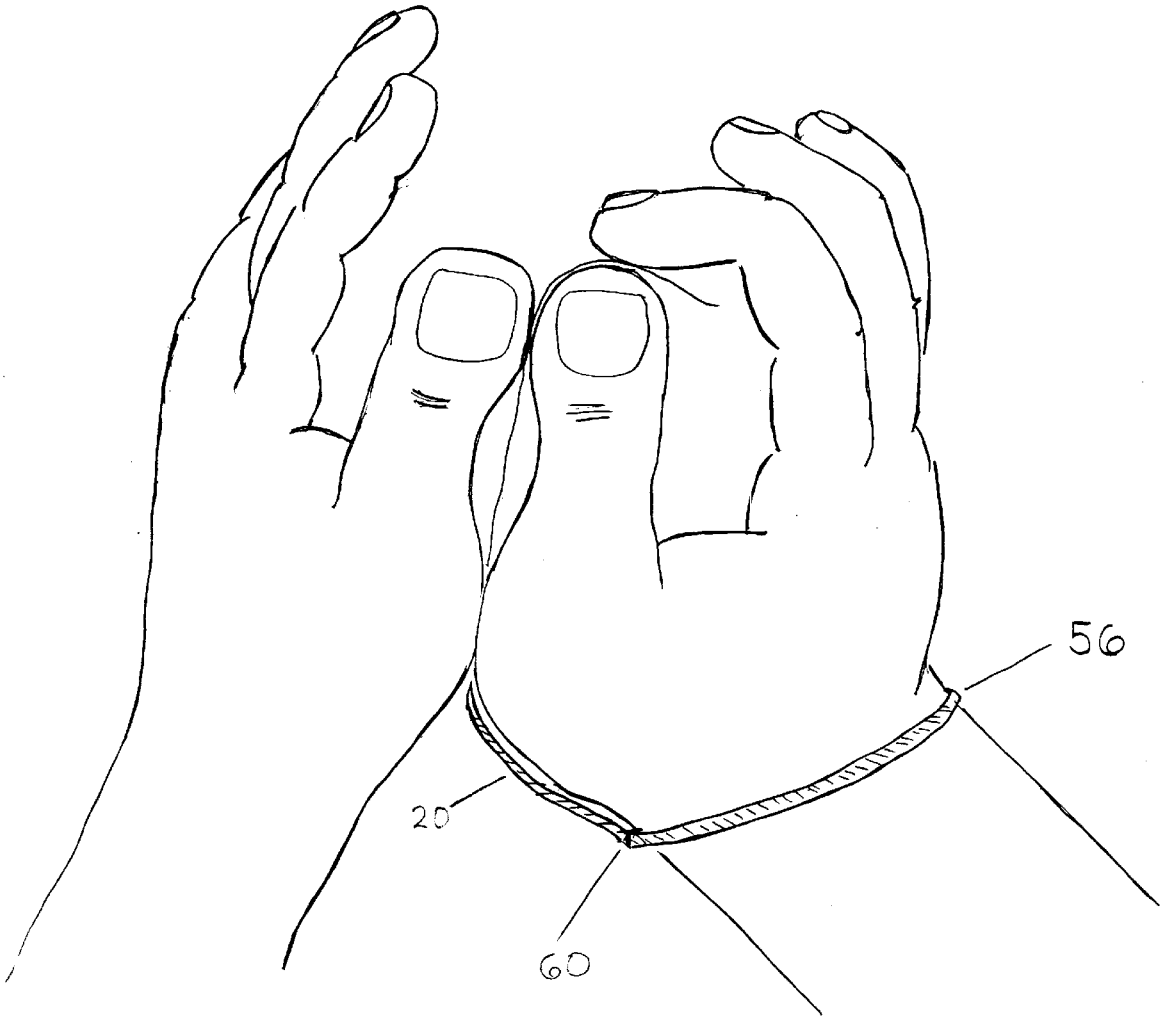
FIG. 14 shows the general arrangement of a ribbon harp held in playing position.

Operation. FIGS. 14, 15A and 15B.

To play the ribbon harp, insert the free end of the ribbon into the loop so that a large loop is formed. Insert the wrist into said large loop and draw it up so that it is tight against the wrist. Either wrist may be used.

Now draw the ribbon harp over the first joint of the thumb and past the second joint of the thumb, ending by passing it over the top of the thumb. The ribbon is held fight against the top of the thumb by the first finger. Bring the opposite hand against the hand holding the ribbon harp in a mirror image. The first and second joints of the thumbs should match up against one and other. See FIG. 14.

Now the player brings his hands to his lips and presses the lips against the thumbs. The axis of the mouth is approximately at right angles to the long axis of the ribbon harp. The lips are held against the thumbs with moderate pressure so that exhaled breath is fairly well sealed against leakage and passes though the lozenge-shaped opening through which the ribbon is passes. The ribbon harp immediately vibrates in response to the stream of exhaled breath. A hard exhale produces a loud note and a small flow of exhaled breath produces a soft note. It is clear from FIG. 14 that the player can cup his or her hands in various shapes, and that the reverberations will alter the timbre of the produced sound.

By cocking the wrist, the tension is increased in the ribbon harp, and it will respond to exhaled breath with a higher note. Slackening the tension will cause it to vibrate slower, and will thus bring forth a lower note in response the exhaled breath. FIGS. 15A and 15B shows how tension in the ribbon harp is increased or decreased by cocking the wrist at different angles. Discrete notes can be played by interrupting the flow of air in the same way that a trumpet player uses the syllable "tu" in order to produce a discrete beginning to a note.

FIGS. 15A and 15B show the use of a polymeric sticky thumb cot on the thumb. It increases friction between the ribbon and the thumb, and is a convenience for the player. FIGS. 15A and 15B also show the wrist gauntlet which forms a means of attachment 66 for the ribbon harp and relieves the discomfort of tension in the ribbon harp loop about the wrist.

SUMMARY, RAMIFICATIONS, AND SCOPE

Accordingly, the reader can see that the ribbon harp is a simple, inexpensive, easy-to-manufacture mouth-blown musical instrument. The simplicity of the ribbon harp allows an almost intuitive grasp of its operation. Thus, the ribbon harp is attractive as a toy to children. However, in the hands of a skilled player it is capable of artistic musical performance.

Careful attention to the engineering details described above allow design of a ribbon harp that has a pleasing and musical tone. A ribbon harp has a distinct fundamental tone under playing conditions and dampening properties which suppress unwanted dissonant or discordant overtones. Further, surface shape and texture can be specified to permit an accurate attack upon notes.

Lastly, a wrist gauntlet and thumb cot are described. These devices reduce fatigue during long sessions and prevent discomfort from a ribbon harp under tension pressing into the wrist.

Although the description above contains many specificities, these should not be construed as limiting the scope of the ribbon harp invention. The descriptions show some preferred embodiments of the ribbon harp. For instance, color and decoration are elements of ribbon harp design which have not been discussed under the above descriptions.

Thus the scope of the invention should be determined by the appended claims and their legal equivalents rather than by the examples given:

I claim:

1. A mouth blown hand-held musical instrument comprising a flexible ribbon having two planar surfaces and two edges whose long axes are parallel to the longitudinal axis of the ribbon; which ribbon may be excited by exhaled breath blown upon it to vibrate in the audible range thus producing a musical note; and whose composition is primarily of a single polymeric material.

2. The ribbon of claim 1 wherein the planarsurfaces are differently textured, whereby a differential pressure across the ribbon surface is produced by different aerodynamic lifts due to the different surface textures, which forces are produced laterally in said ribbon and said ribbon begins to vibrate immediately with the initial exhalation of breath blown across it, thus providing a means to produce an immediate attack upon the note as well as facilitating the ability to play soft passages.

3. The ribbon of claim 1 wherein the planar surfaces have different aerodynamic profiles whereby a differential pressure across the ribbon surface is produced by different aerodynamic lifts due to the different aerodynamic profiles; which forces are produced laterally in said ribbon and said ribbon begins to vibrate immediately with the initial exhalation of breath blown across it, thus providing a means to produce an immediate attack upon the note as well as facilitating the ability to play soft passages.

4. The ribbon of claim 1 wherein lengthwise fibers are introduced into the polymeric matrix, thus providing a means to substantially increase the strength of said ribbon in the longitudinal direction, thus providing a means for said ribbon to have an accurate tonal response to tension inputs from the player.

5. The ribbon of claim 1 further including one end formed into a small loop, whereby a large loop can be formed by feeding the bight of said ribbon through said small loop, thus providing a means to fix said ribbon to the wrist of the player.

6. The ribbon of claim 1 further including a mechanical hook attached to one end, thus providing a means for conveniently attaching said ribbon to a wrist gauntlet.

7. A mouth blown hand-held musical instrument comprising a flexible ribbon having two planar surfaces and two edges whose long axes are parallel to the longitudinal axis of the ribbon; which ribbon may be excited by exhaled breath blown upon it to vibrate in the audible range thus producing a musical note; and of woven contruction having threads running both parallel to the longitudinal axis of the ribbon and also crosswise to the longitudinal axis.

8. The ribbon of claim 7 wherein the lengthwise threads are of greater tensile strength than the crosswise threads so that said ribbon is relatively strong in tension, thus providing a means for said ribbon to have accurate tonal response to tension inputs by the player.

9. The ribbon of claim 7 wherein the crosswise threads are of different damping properties than the lengthwise threads, thus providing a means of damping unwanted overtones which may be associated with the fundamental frequency.

10. The ribbon of claim 7 wherein the woven structure is impregnated with a resin, thus providing a means of damping unwanted overtones which may be associated with the fundamental frequency.

11. The ribbon of claim 7 wherein threads are impregnated with resin before being woven, thus providing a means of damping unwanted overtones which may be associated with the fundamental frequency.

12. The ribbon of claim 7 wherein the edges are made into selvedge, thus providing a means to impart resistance to unraveling to said ribbon.

13. The ribbon of claim 7 whose surface is textured, whereby a differential pressure across the ribbon surface is produced by different aerodynamic lifts due to the different surface textures; which forces are produced laterally in said ribbon and said ribbon begins to vibrate immediately with the initial exhalation of breath blown across it, thus providing a means to produce an immediate attack upon the note as well as facilitating the ability to play soft passages.

14. The ribbon of claim 7 wherein the lengthwise threads are of varying diameters, whereby both tensile strength and surface texture are imparted to said ribbon, thus providing a means for said ribbon to have accurate tonal response to tension inputs by the player as well as facilitating the immediate attack upon notes.

15. The ribbon of claim 7 further including one end formed into a small loop, whereby a large loop can be formed by feeding the bight of said ribbon through said small loop, thus providing a means to fix the vibrating ribbon to the wrist of the player.

16. The ribbon of claim 7 further including a mechanical hook affixed to one end, thus providing a means for conveniently attaching the vibrating ribbon to a wrist gauntlet.

17. A wrist gauntlet comprised of a wide wrist strap and a means for the attachment of the ribbon, whereby the player can alter the angle of the wrist and arm so that the large muscles of the arm come into play to produce varying tensions in said ribbon while at the same time distributing the forces over a greater area of the players wrist, thus providing both a means for increasing the comfort with which the instrument is played over a long playing session and a means to facilitate the use of large strong muscles in the arm and shoulder to produce tension in the ribbon.

18. A thumb cot of sticky polymeric material whereby the grip of the thumb-tip against the ribbon is enhanced, thus providing a means of playing long sessions without fatigue from gripping the end of said ribbon.

* * * * *